US012604957B2

(12) United States Patent
Cabunoc et al.

(10) Patent No.: US 12,604,957 B2
(45) Date of Patent: Apr. 21, 2026

(54) DEVICE COVER ASSEMBLIES FOR PORTABLE DEVICE PROTECTION INSIDE RECEPTACLES

(71) Applicant: TARGUS INTERNATIONAL LLC, Anaheim, CA (US)

(72) Inventors: Alex Robert Cabunoc, Irvine, CA (US); Gino Salvatore Romano, Aliso Viejo, CA (US); Jonny Yuan, Placentia, CA (US); Daniel Ballou, Long Beach, CA (US); Joven De La Vega, Downey, CA (US)

(73) Assignee: Targus International LLC, Anaheim, CA (US)

( * ) Notice: Subject to any disclaimer, the term of this patent is extended or adjusted under 35 U.S.C. 154(b) by 202 days.

(21) Appl. No.: 18/518,254

(22) Filed: Nov. 22, 2023

(65) Prior Publication Data

US 2024/0172853 A1 May 30, 2024

Related U.S. Application Data

(60) Provisional application No. 63/385,348, filed on Nov. 29, 2022.

(51) Int. Cl.
*A45C 11/00* (2006.01)
*B65D 77/04* (2006.01)
(Continued)

(52) U.S. Cl.
CPC ..... *A45C 11/00* (2013.01); *B65D 77/04* (2013.01); *B65D 81/022* (2013.01); *B65D 85/30* (2013.01); *A45C 11/003* (2025.01)

(58) Field of Classification Search
CPC . A45C 11/003; A45C 11/00; A45C 2013/025; A45C 13/02; B65D 85/30; B65D 81/022; B65D 77/04
(Continued)

(56) References Cited

U.S. PATENT DOCUMENTS 963,229 A 7/1910 Leighton
4,210,230 A 7/1980 Weiner
(Continued)

FOREIGN PATENT DOCUMENTS

CN 203505783 U 4/2014
KR 20140022393 A 2/2014
(Continued)

OTHER PUBLICATIONS

"Targus 15-16" Zero Waste Backpack (TBB641GL)" (Amazon) Feb. 7, 2023 (Feb. 7, 2023) [online] (retrieved from the internet on Nov. 6, 2023) <URL https://www.amazon.com/Targus-15- 16-Waste-Backpack-TBB641GUdp/BOBV479JJM?th=1 >, entire document.
(Continued)

*Primary Examiner* — Chun Hoi Cheung
(74) *Attorney, Agent, or Firm* — Stoel Rives LLP

(57) ABSTRACT

The disclosure describes a system or an apparatus for providing protection for a device. In one aspect, the system or the apparatus includes an outer cover and an inner cover. The inner cover fits inside the outer cover, and the device may be inserted inside the inner cover. A closed end of the inner cover sits higher than a closed end of the outer cover, creating an air gap between the closed ends of the inner and outer covers. The air gap may provide shock absorption for the device. The inner cover may also include one or more perforations of the composite material of the inner cover. The one or more perforations may provide a slinging motion of the device, which help increase shock absorption, provide shock dampening from the motions of the device, and/or increase elastoplasticity of the composite material of the inner cover.

14 Claims, 3 Drawing Sheets

(51) Int. Cl.
*B65D 81/02* (2006.01)
*B65D 85/30* (2006.01)

(58) Field of Classification Search
USPC ..... 206/591, 523, 521, 587, 320, 305, 583
See application file for complete search history.

(56) References Cited

U.S. PATENT DOCUMENTS

| | | | | |
|---|---|---|---|---|
| 4,541,556 | A | 9/1985 | Collins et al. | |
| 5,160,001 | A | 11/1992 | Marceau | |
| 5,217,119 | A * | 6/1993 | Hollingsworth | A45C 13/02 190/902 |
| 6,210,037 | B1 | 4/2001 | Brandon | |
| RE37,915 | E | 12/2002 | Lapoint | |
| 6,827,185 | B2 * | 12/2004 | Scicluna | A45C 13/02 190/110 |
| 6,948,600 | B2 * | 9/2005 | Chuang | A45C 3/02 206/583 |
| 7,216,763 | B2 | 5/2007 | Gormick et al. | |
| 7,293,635 | B2 | 11/2007 | Repke et al. | |
| 7,467,695 | B2 | 12/2008 | Gormick et al. | |
| 7,503,440 | B2 | 3/2009 | Gormick et al. | |
| 7,540,378 | B2 | 6/2009 | Gallagher | |
| 7,631,756 | B2 * | 12/2009 | Picot | A45C 13/02 206/583 |
| 7,747,007 | B2 | 6/2010 | Hyun et al. | |
| 7,845,508 | B2 | 12/2010 | Rothschild et al. | |
| 8,164,222 | B2 | 4/2012 | Baarman | |
| 8,413,808 | B1 | 4/2013 | Tong | |
| 8,448,828 | B2 | 5/2013 | Nitti | |
| 8,567,578 | B2 | 10/2013 | Cuong et al. | |
| 8,714,389 | B2 | 5/2014 | Rothschild et al. | |
| 8,777,174 | B2 | 7/2014 | Hynell | |
| 8,789,731 | B2 | 7/2014 | Hart | |
| 9,238,540 | B2 | 1/2016 | Wyner et al. | |
| 9,300,768 | B1 | 3/2016 | Dining et al. | |
| 9,320,341 | B2 | 4/2016 | Majeau | |
| 9,326,574 | B2 | 5/2016 | Dissegna | |
| 9,480,317 | B2 | 11/2016 | Rothschild et al. | |
| 9,750,321 | B2 | 9/2017 | Kandel | |
| 9,814,298 | B2 | 11/2017 | Paduano et al. | |
| 10,092,074 | B2 | 10/2018 | Rothschild et al. | |
| 10,575,612 | B2 | 3/2020 | Meservey | |
| 10,952,522 | B2 | 3/2021 | D'Alessandro | |
| 11,359,755 | B2 | 6/2022 | Molineux | |
| 11,399,605 | B2 | 8/2022 | Ratigan | |
| 2005/0241972 | A1 * | 11/2005 | Hassett | A45C 5/06 206/320 |
| 2006/0144663 | A1 * | 7/2006 | Gullen | A45C 13/02 190/110 |
| 2007/0025647 | A1 | 2/2007 | Hamlin | |
| 2008/0035506 | A1 | 2/2008 | Rostami | |
| 2009/0071782 | A1 * | 3/2009 | Rasmussen | G06F 1/1628 190/109 |
| 2010/0022285 | A1 | 1/2010 | Randall et al. | |
| 2010/0312938 | A1 | 12/2010 | Stampfli | |
| 2011/0198374 | A1 | 8/2011 | Majeau | |
| 2015/0055292 | A1 | 2/2015 | Lee et al. | |
| 2015/0119118 | A1 | 4/2015 | Ashley et al. | |
| 2015/0266646 | A1 * | 9/2015 | Feng | B65D 81/075 206/583 |
| 2016/0285301 | A1 | 9/2016 | Kim | |
| 2016/0324300 | A1 | 11/2016 | Wronski | |
| 2016/0372973 | A1 | 12/2016 | Fitzgerald et al. | |
| 2018/0062417 | A1 | 3/2018 | Choi et al. | |
| 2019/0075900 | A1 | 3/2019 | Hynecek et al. | |
| 2019/0191836 | A1 | 6/2019 | Fields | |
| 2019/0256276 | A1 | 8/2019 | Barlas et al. | |
| 2020/0253349 | A1 | 8/2020 | Quartarone, III | |
| 2020/0352294 | A1 | 11/2020 | Davis | |
| 2021/0030128 | A1 | 2/2021 | Rabe | |
| 2021/0186186 | A1 | 6/2021 | D'Alessandro | |
| 2021/0330101 | A1 | 10/2021 | Tencza | |
| 2022/0041323 | A1 | 2/2022 | Semmelhack et al. | |

FOREIGN PATENT DOCUMENTS

| | | | |
|---|---|---|---|
| WO | 2006105791 | A2 | 10/2006 |
| WO | 2020237908 | A1 | 12/2020 |
| WO | 2022090745 | A1 | 5/2022 |
| WO | 2022140727 | A1 | 6/2022 |

OTHER PUBLICATIONS

International Search Report and Written Opinion for International PCT Application No. PCT/US2023/060255, mailed May 12, 2023, 11 pages.

"DIV: Bag Base Shaper" (Mantharay27) Jul. 17, 2012 (Jul. 17, 2012), [online] (retrieved from the internet on Nov. 6, 2023) <URL https://www.youtube.com/watch?v=2GHOkeJQHEw>, entire document, especially Time 0:01 min; Time 0:10-0:14 min; Time 0:30-3:30 min.

International Search Report and Written Opinion received for International PCT Application No. PCT/US2023/081118, mailed Mar. 18, 2024, 13 pages.

* cited by examiner

DEVICE COVER ASSEMBLIES FOR PORTABLE DEVICE PROTECTION INSIDE RECEPTACLES

CROSS-REFERENCE TO RELATED APPLICATION(S)

This application claims priority to U.S. Provisional application No. 63/385,348 filed Nov. 29, 2022, which is incorporated herein by reference, in its entirety, for any purpose.

TECHNICAL FIELD

The present disclosure relates generally to the field of electronic device protection. Examples are described that includes an equipment to protect portable electronic devices inside receptacles.

BACKGROUND

Backpacks, suitcases, handbags, messenger bags, briefcases, laptop bags, and the like are often used by a user, such as a student, a traveler, a lawyer, an engineer, and/or another other professional to carry a portable electronic device (e.g., a laptop computer) and/or other items. Although the design, dimensions, the color, the material, the price, and the overall purpose of the backpacks, the suitcases, the handbags, the messenger bags, the briefcases, and/or the laptop bags can vary, the user expects some degree of protection for the portable electronic device.

The global market size of the backpacks, suitcases, handbags, messenger bags, briefcases, laptop bags, or a combination thereof is valued at tens of billions of U.S. dollars, and the market size is currently projected to grow more in the coming years. Manufacturers strive to design and manufacture better backpacks, suitcases, handbags, messenger bags, briefcases, laptop bags, or a combination thereof to satisfy the needs and/or preferences of a growing number of users.

DETAILED DESCRIPTION

Various embodiments of the present disclosure will be explained below in detail with reference to the accompanying drawings. The following detailed description refers to the accompanying drawings that show, by way of illustration, specific aspects and embodiments of the disclosure. The detailed description includes sufficient detail to enable those skilled in the art to practice the embodiments of the disclosure. Other embodiments may be utilized, and structural, logical, and electrical changes may be made without departing from the scope of the present disclosure. The various embodiments disclosed herein are not necessary mutually exclusive, as some disclosed embodiments can be combined with one or more other disclosed embodiments to form new embodiments. Thus, the following more detailed description of the embodiments of the systems, methods, and apparatuses is not intended to limit the scope of the disclosure, but is merely representative of possible embodiments of the disclosure. In some cases, well-known structures, materials, or operations are not shown or described in detail.

The disclosure describes a system or an apparatus for providing protection for a device. The device may be a laptop computer, a notebook computer, a digital notepad, a smartphone, a tablet, or another portable electronic device. In one aspect, the system or the apparatus includes an outer cover and an inner cover. In some examples, the inner cover may be a sling unit and the outer cover may be a cradle unit. The sling unit may fit inside the cradle unit, and the device may be inserted inside the sling unit. A closed end of the sling unit is configured to sit higher than a closed end of the cradle unit, creating an air gap between the sling sitting and the cradle unit. The air gap provides shock absorption for the device. The sling unit may also include a perforation(s) of the composite material of the sling unit. The perforation(s) provide a slinging motion of the device, which helps increase shock absorption, provide shock dampening from the motions of the device, and/or increase elastoplasticity of the composite material of the sling unit.

Figure 1:
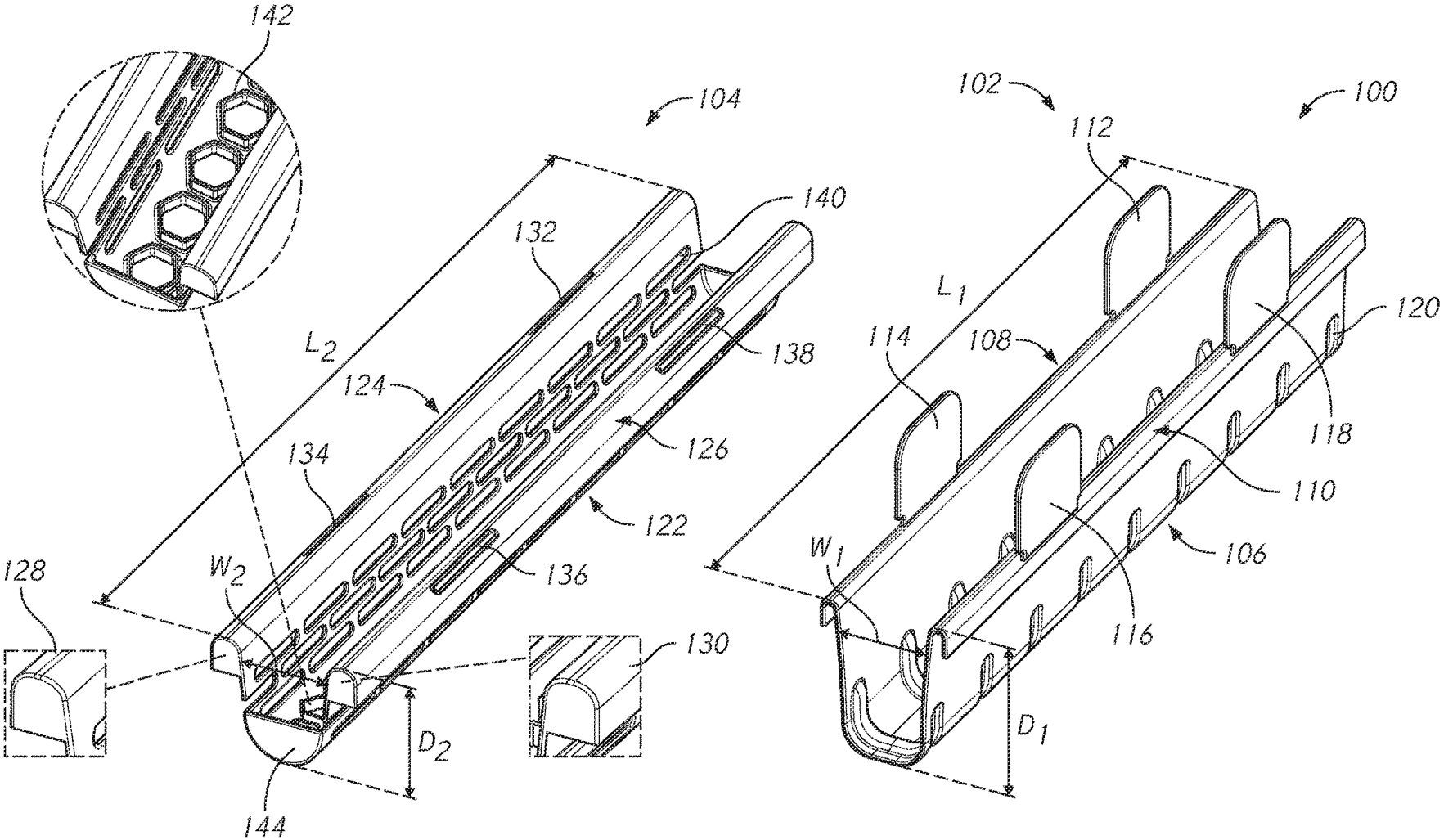
FIG. 1 illustrates a system including a cradle unit and a sling unit in accordance with examples described herein.

FIG. 1 illustrates a system 100 including a cradle unit 102 and a sling unit 104 in accordance with examples described herein. In some examples, the cradle unit 102 may function as an outer cover and the sling unit 104 may function as an inner cover. The system 100 including the cradle unit 102 and the sling unit 104 may provide protection for a device, In some examples, the device may be an electronic device, such as a laptop computer, a notebook computer, a digital notepad, a smartphone, a tablet, or another portable electronic device. However the device may not be limited to an electronic device and/or a portable device.

In some examples, the cradle unit 202 may store the sling unit 204 inside thereof. As is described or illustrated, for example, in FIGS. 2 and 3, the sling unit 104 fits inside the cradle unit 102 to assemble, or during the assembly of, the system 100. The assembly of the system 100 may be performed by a user or an end user, or the system 100 may be pre-assembled at, for example, a manufacturing or a packaging facility. In some embodiments, the system 100 may be manufactured as a single unit, where the sling unit 104 (or a sling module) and the cradle unit 102 (or a cradle module) are sub-units, modules, or components of the system 100.

In some embodiments, the cradle unit 102 may be an approximately U-shaped cradle unit (or a bathtub-shaped cradle unit) with a first outer length ("$L_1$"), a first inner width ("$W_1$"), and a first depth ("$D_1$"). Since the cradle unit 102 may be a U-shaped cradle unit, the cradle unit 102 may include a cradle closed end 106, a first cradle open end 108, and second cradle open end 110.

Figure 2:
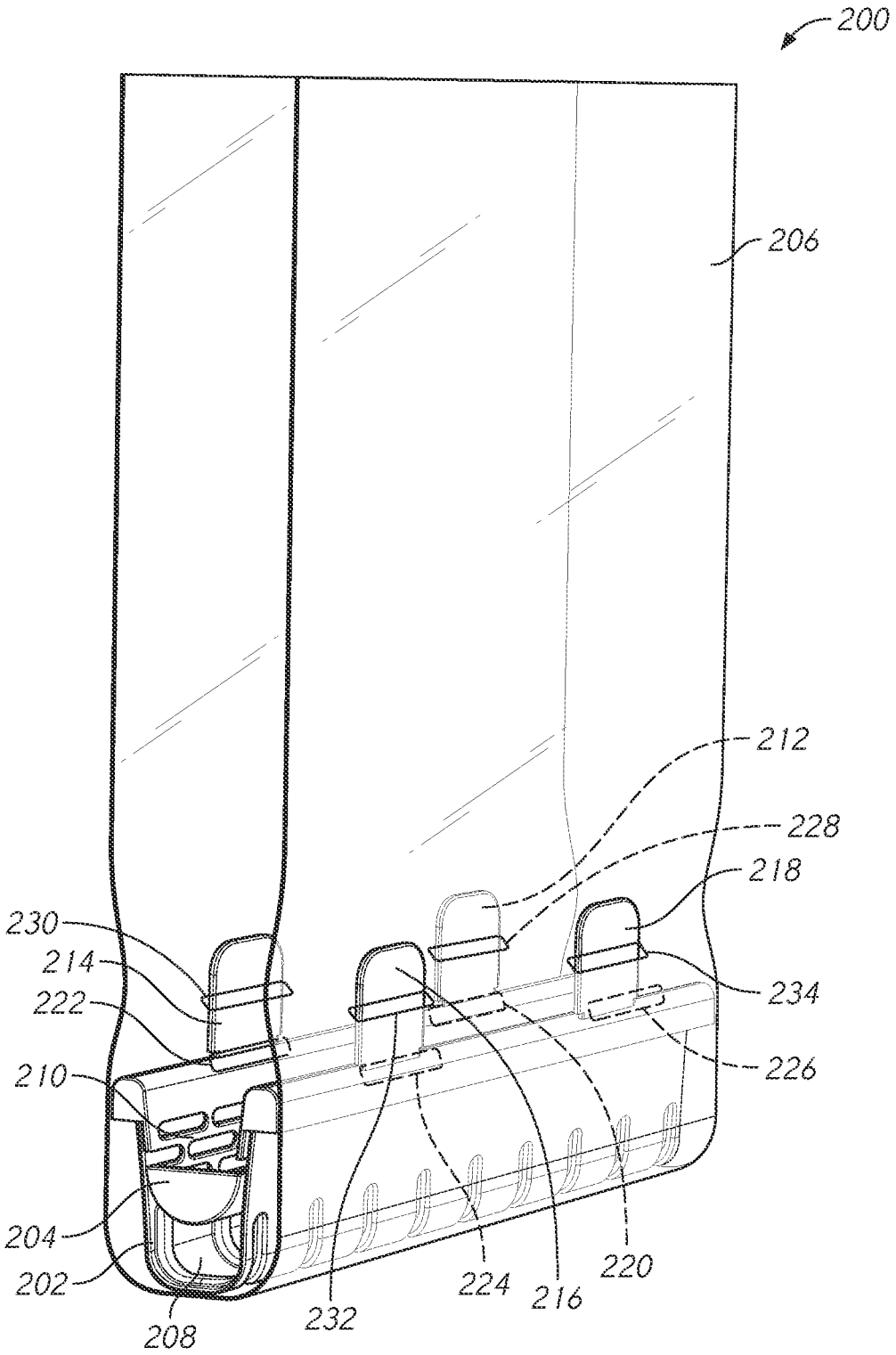
FIG. 2 illustrates a system including a cradle unit and a sling unit in accordance with examples described herein.

In some embodiments, at each of the open end of the cradle unit 102, the cradle unit 102 may also include one or more tabs, such as a first cradle tab 112, a second cradle tab 114, a fourth cradle tab 118, a third cradle tab 116, fewer tabs than the count of tabs illustrated in FIG. 1, or more tabs than the count of tabs illustrated in FIG. 1. The tabs of the cradle unit 102 may provide anchoring for the sling unit 104, when the sling unit 104 and the cradle unit 102 are assembled together. In some embodiments, the tabs may provide stability inside the bag, or the compartment of the bag, when the system 100 is inserted inside the bag, or the compartment of the bag, as is illustrated in FIG. 2.

In some embodiments, the cradle unit 102 may be manufactured using a first composite material, and the sling unit 104 may be manufactured using a second composite material. In some embodiments, the composite material of the sling unit 104 has greater elastoplasticity than the composite material of the cradle unit 102. For example, the cradle unit 102 may be manufactured using a polyethylene (PE) material. As another example, the sling unit 104 may be manufactured using a thermoplastic polyurethane (TPU) material. In some embodiments, the thickness of the composite material of the cradle unit 102 and the thickness of the composite material of the sling unit 104 may be the same or may be different.

In some embodiments, the cradle unit 102 includes a plurality of molded ribbings of the composite material (e.g., the PE material) to increase a rigidity of the composite material, to increase structural strength of the cradle unit 102, or a combination thereof. For ease of illustration, FIG. 1 illustrates a molded ribbing 120 that may be a portion of the plurality of the molded ribbings of the cradle unit 102. The molded ribbings (including the molded ribbing 120) help increase the rigidity of the composite material of the cradle unit 102 and/or increase structural strength of the cradle unit 102, while reducing (or obviating increasing) the thickness of the composite material of the cradle unit 102. Accordingly, the reduced thickness of the composite material of the cradle unit 102 may result in a reduced weight and/or a reduced volume of the cradle unit 102.

FIG. 1 illustrates that each of the first cradle open end 108 and the second cradle open end 110 includes a lip, an outward bend, and/or an outward curvature of the composite material. In some embodiments, however, each of the first cradle open end 108 and the second cradle open end 110 may not include a lip, an outward bend, and/or an outward curvature of the composite material of the cradle unit 102.

In some embodiments, the sling unit 104 may be an approximately U-shaped sling unit (or a bathtub-shaped sling unit) with a second outer length ("$L_2$"), a second inner width ("$W_2$"), and a second depth ("$D_2$"). Since the sling unit 104 may be a U-shaped sling unit, the sling unit 104 may include a sling closed end 122, a first sling open end 124, and a second sling open end 126. In some embodiments, the second inner width of the sling unit 104 is less than the first inner width of the cradle unit 102, allowing the sling unit 104 to fit inside the cradle unit 102, as is illustrated and/or described, partly, with reference to FIGS. 2 and 3. In some embodiments, the second depth ($D_2$) of the sling unit 104 is less than the first depth ($D_1$) of the cradle unit 102, creating an air gap (see FIGS. 2 and 3) between the sling closed end 122 and the cradle closed end 106, since the sling closed end 122 sits higher than the cradle closed end 106. The air gap may provide shock absorption for the device. In some examples, the sling closed end 122 and the cradle closed end 106 may have round corners. The round corners may prevent shock that might have been created between corners of a closed end of the system 100 and a hard surface in contact with the system 100.

In some embodiments, the sling unit 104 may include a first lip 128 and a second lip 130 along the first sling open end 124 and the second sling open end 126, respectively, as illustrated in FIG. 1. The first lip 128 and the second lip 130 of the sling unit 104 may fit on top of the first cradle open end 108 and the second cradle open end 110 of the cradle unit 102, respectively. By so doing, the first lip 128 and second lip 130 of the sling unit 104 prevents the air gap from considerably shrinking, collapsing, or a combination thereof due to motions, or downward force, of the device.

In some embodiments, each of the first sling open end 124 and the second sling open end 126 of includes one or more cutouts that are, sized for, and may fit around one or more tabs of the cradle unit 102 when the system 100 is assembled. For example, a first sling cutout 132, a second sling cutout 134, a third sling cutout 136, and a fourth sling cutout 138 of the sling unit 104 may receive or fits around the first cradle tab 112, the second cradle tab 114, the third cradle tab 116, and the fourth cradle tab 118 of the cradle unit 102, respectively. The tabs of the cradle unit 102 may provide anchoring for the sling unit 104, when the sling unit 104 and the cradle unit 102 are assembled together. Thus, the inner cover may be attached to the outer cover. While the examples of FIGS. 1-3 describe cutouts in a sling unit and tabs in a cradle unit, the cutouts and tabs may be included in the cradle unit and the sling unit in some other examples.

In some embodiments, the sling unit 104 includes perforation(s) 140 of the composite material (e.g., the TPU material) of the sling unit 104. For example, the perforation (s) 140 may be located between the first sling open end 124 and the sling closed end 122, and/or between the second sling open end 126 and the sling closed end 122. The perforation(s) 140 of the composite material of the sling unit 104 increase a slinging motion of the device caused by motions of the device, the user, the bag, the compartment of the bag that holds the device, or a combination thereof. In some aspects, the slinging motion of the device may increase shock absorption. In other aspects, the slinging motion of the device may provide shock dampening. In yet other aspects, the perforation(s) 140 of the composite material of the sling unit 104 may increase elastoplasticity of the composite material of the sling unit 104.

In some embodiments, the sling unit 104 may include extrusions or protrusions at the bottom of the sling closed end 122 that may provide further shock absorption from the motions of the device. In some examples, the sling unit 104 may have an extruded shape(s) 142 at the bottom of the sling closed end 122. In some examples, the extruded shape(s) 142 may be formed around openings at the bottom of the sling closed end 122. The extruded shape(s) 142 For example, if the user drops their bag carrying the device, the downward motion and/or force of the device may be considerably large. In such a case, the extruded shape(s) 142 may help reduce the shock absorption and/or may provide shock dampening. FIG. 1 illustrates the extruded shape(s) 142 as being a hexagon extruded shape(s). The extruded shape(s) 142, however, may be a variety of three-dimensional (3D) volumetric region(s) and/or shape(s), such as a cuboid(s), a polyhedron(s), a cylinder(s), a sphere(s), a cone(s), a pyramid(s), a prism(s), a torus(es), or a combination thereof.

In some embodiments, the sling unit 104 may include a first side wall (e.g., a side wall 144) at a first edge (e.g., the beginning) of the second outer length ($L_2$), and a second side wall at a second edge (e.g., the end) of the second outer length ($L_2$). The side walls may prevent the portable device from sliding off the sling unit 104 when the portable device moves along the second outer length ($L_2$).

FIG. 1 illustrates a system 200 including a cradle unit 202 and a sling unit 204 in accordance with examples described herein. In some examples, the system 200 is inside a liner 206, in accordance with examples described herein. FIG. 2 is illustrated and/or described in the context of FIG. 1. In some examples, the cradle unit 202 may function as an outer cover and the sling unit 204 may function as an inner cover.

In some embodiments, the liner 206 may be part of, or inside, a device compartment of a bag or carrier. The device compartment and/or the bag or carrier are not explicitly illustrated in FIG. 2. The system 200 is configured to fit inside (e.g., in the interior) or in the exterior of a bag, for example, at the bottom of the bag or at some other position regarding the inside or the exterior of the bag, such inside a pocket or a dedicated compartment (or a device compartment) in the interior or in the exterior the bag. For example, the bag may include a dedicated compartment for a portable device (or a portable device compartment), where the user may insert their device. The device compartment of the bag may include or may be separated by the liner 206. As described, the device may be a laptop computer, a notebook computer, a digital notepad, a smartphone, a tablet, or another portable electronic device. However the device may not be limited to an electronic device and/or a portable device. Accordingly, depending on type or size of the device, the bag may be a laptop bag or a laptop carrier, a backpack, a suitcase, a handbag, a messenger bag, a briefcase, or another type of bag or carrier.

In some examples, the cradle unit 202 may store the sling unit 204 inside thereof. The assembled cradle unit 202 and sling unit 204 include an air gap 208, and the air gap 208 provides shock absorption for the device. As described, a first lip and a second lip along a first open end and a second open end of the sling unit 204, respectively, are configured to fit on top of a first open end and a second open end of the cradle unit 202. The fitting of the first lip and the second lip of the sling unit 204 prevents the air gap 208 from considerably shrinking, collapsing, or a combination thereof due to motions of the device. As described, the sling unit 204 further includes perforation(s) 210 to increase a slinging motion of the device, to increase shock absorption from the motions of the device, to provide shock dampening from the motions of the device, to increase elastoplasticity of the composite material of the sling unit 204, or a combination thereof. Should the motions and/or the shock be considerably large, the sling unit 204 also includes extruded geometric shapes (not explicitly illustrated in FIG. 2) at the bottom of the closed end of the sling unit 204. These extruded geometric shapes offer further protection for the device.

In some embodiments, to anchor the sling unit 204 onto the cradle unit 202, the cradle unit 202 includes one or more tabs, such as a first cradle tab 212, a second cradle tab 214, a third cradle tab 216, a fourth cradle tab 218, fewer tabs than illustrated, or more tabs than illustrated. Accordingly, the sling unit 204 includes one or more cutouts sized to fit around the one or more tabs, such as a first sling cutout 220, a second sling cutout 222, a third sling cutout 224, a fourth sling cutout 226, fewer sling cutouts than illustrated, or more sling cutouts than illustrated. Generally, the count of the sling cutouts is the same as the count of the cradle tabs. The fitting of the sling cutouts around the cradle tabs anchor the sling unit 204 onto the cradle unit 202.

In some embodiments, the system 200 (e.g., the assembled sling unit 204 and the cradle unit 202) is anchored to the liner 206 and/or the device compartment of the bag. To do so, the liner 206 includes one or more liner cutouts, such as a first liner cutout 228, a second liner cutout 230, a third liner cutout 232, a fourth liner cutout 234, fewer liner cutouts than illustrated, or more liner cutouts than illustrated. Generally, the count of the liner cutouts is the same as the count of the cradle tabs.

Figure 3:
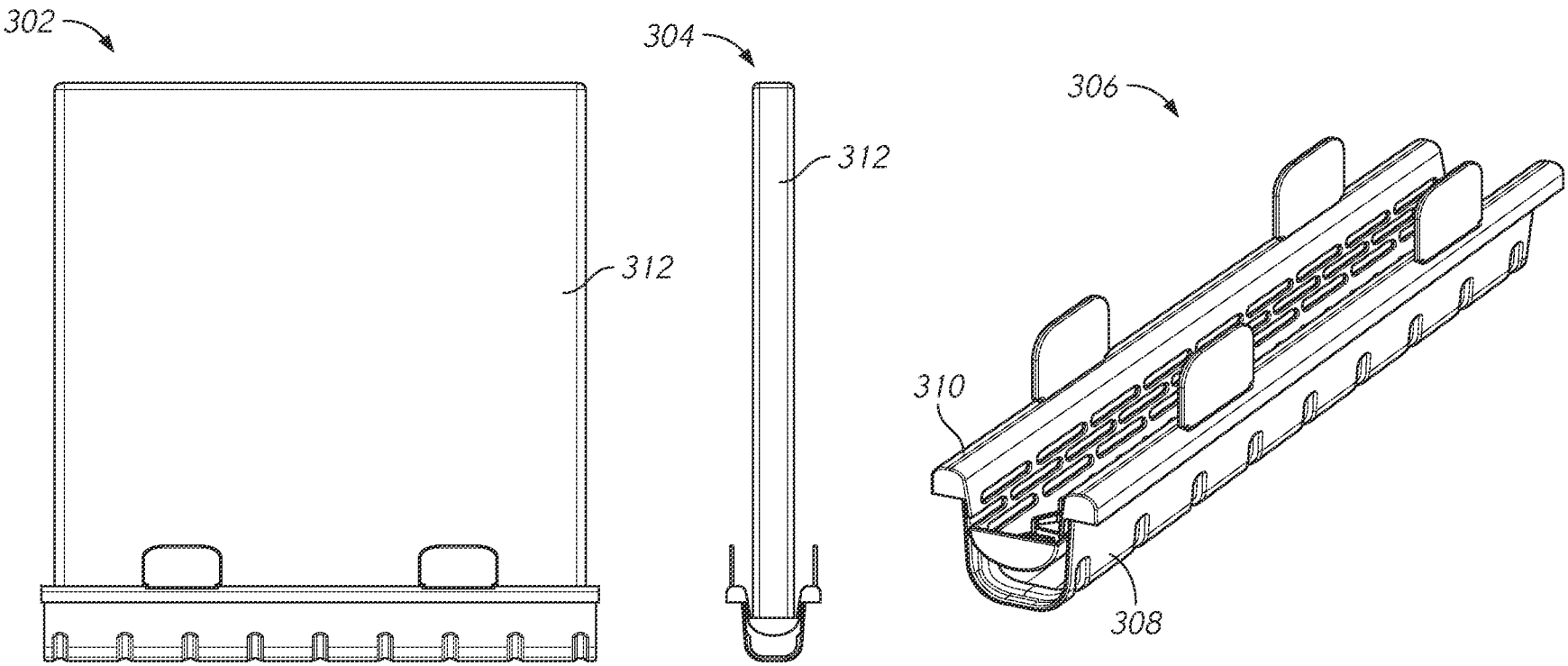
FIG. 3 illustrates example drawings of a side view a front view, and a perspective view of the assembled cradle unit and sling unit, in accordance with examples described herein.

FIG. 3 illustrates example drawings 300 of a side view 302, a front view 304, and perspective view 306 of an assembled cradle unit 308 and sling unit 310, in accordance with examples described herein. FIG. 3 is described and/or illustrated in the context of FIGS. 1 and 2. For the sake of brevity, FIG. 3 is not described in details, since the cradle unit 308 and the sling unit 310 may be the same as, similar to, or equivalent to, the cradle unit and sling unit of FIGS. 1 and/or 2. Nevertheless, the device of FIG. 3 is illustrated as a laptop computer 312. Therefore, as previously described, in some embodiments, a system having a cradle unit 308 and sling unit 310 may provide protection for the laptop computer 312. The assembled cradle unit 308 and sling unit 310 and the laptop computer 312 may be inside a bag (e.g., a laptop bag) or inside a laptop compartment located inside or on the exterior of the bag.

As described herein, a system or the apparatus for providing protect a device in a bag includes an outer cover and inner cover. Various manners to attach the outer cover and the inner cover in a stable manner to prevent moving of the device while reducing shock to the device, a bag without appropriate protection to a device, such as an electronic and or portable device may be provided.

Disclosed herein are various exemplary embodiments for a display and docking apparatus. As can be appreciated by one of skill in the art, any one or more of the features, functions, and structure provided in one embodiment can be utilized in another disclosed embodiment. Thus, many, if not all of the features, functions, and structure are interchangeable with the disclosed embodiments.

This disclosure has been made with reference to various exemplary embodiments, including the best mode. However, those skilled in the art will recognize that changes and modifications may be made to the exemplary embodiments without departing from the scope of the present disclosure. While the principles of this disclosure have been shown in various embodiments, many modifications of structure, arrangements, proportions, elements, materials, and components may be adapted for a specific environment and/or operating requirements without departing from the principles and scope of this disclosure. These and other changes or modifications are intended to be included within the scope of the present disclosure.

From the foregoing it will be appreciated that, although specific embodiments of the disclosure have been described herein for purposes of illustration, various modifications may be made without deviating from the spirit and scope of the disclosure. Accordingly, the scope of the disclosure should not be limited to any of the specific embodiments described herein.

This disclosure is to be regarded in an illustrative rather than a restrictive sense, and all such modifications are intended to be included within the scope thereof. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element. The scope of the present invention should, therefore, be determined by the following claims.

What is claimed is:

1. A system for providing protection for a device, the system comprising:

an outer cover having a first outer length, a first inner width, a first depth, and one or more tabs; and an inner cover having a second outer length, a second inner width less than the first inner width, a second depth, and one or more cutouts having a size corresponding to a size of the one or more tabs, the inner cover configured to store the device, wherein the inner cover is configured to fit inside the outer cover, wherein the outer cover comprises a first closed end and the inner cover comprises a second closed end sitting higher than the first closed end, and wherein the one or more cutouts are configured to receive the one or more tabs to attach the inner cover to the outer cover.

2. The system of claim 1, wherein the inner cover comprises a first side wall and a second side wall at a first end and a second end of the second outer length, respectively, and wherein the first and the second side walls are configured to prevent the device from sliding off the inner cover when the device moves along the second outer length.

3. The system of claim 1, wherein the device comprises a laptop computer.

4. The system of claim 1, wherein the first depth and the second depth less than the first depth are configured to provide a gap between the first closed end and the second closed end, the gap configured to provide shock absorption for the device.

5. The system of claim 4, wherein the inner cover comprises a first lip and a second lip along a first open end and a second open end, respectively, wherein the outer cover comprises a first open end and a second open end, wherein the first lip and the second lip are configured to be in contact with the first open end and the second open end of the outer cover respectively, and wherein the contacts between the first and second lips of the inner cover and the first and second open ends of the outer cover are configured to stabilize the air gap to prevent shrinking, collapsing, or a combination thereof due to motions of the device.

6. The system of claim 1, wherein the outer cover comprises a first composite material, and the inner cover comprises a second composite material, and wherein the second composite material has greater elastoplasticity than the first composite material.

7. The system of claim 6, wherein the first composite material comprises a polyethylene (PE) material, and the second composite material comprises a thermoplastic polyurethane (TPU) material.

8. The system of claim 6, wherein the outer cover comprises a plurality of molded rib-like structures of the first composite material to increase a rigidity of the first composite material, a structural strength of the outer cover, or a combination thereof.

9. The system of claim 6, wherein the inner cover comprises a plurality of perforations of the second composite material configured to increase a slinging motion of the device, to increase shock absorption from the motions of the device, to dampen shock from the motions of the device, to increase elastoplasticity of the second composite material, or a combination thereof.

10. The system of claim 1, wherein the inner cover comprises one or more extruded geometric shapes at a bottom of the closed end of the inner cover, and wherein the one or more extruded geometric shapes are configured to provide further shock absorption from the motion of the device.

11. The system of claim 10, wherein the one or more extruded geometric shapes comprise one or more hexagonal extruded shapes.

12. The system of claim 10, wherein each of the one or more extruded geometric shapes comprises a three-dimensional (3D) volumetric region, wherein the 3D volumetric region is defined by a cuboid, a polyhedron, a cylinder, a sphere, a cone, a pyramid, a prism, a torus, or a combination thereof.

13. The system of claim 1, wherein the outer cover is configured to fit inside a bag.

14. The system of claim 13, wherein the bag comprises a laptop bag or carrier, a backpack, a suitcase, a handbag, a messenger bag, or a briefcase.

* * * * *